United States Patent [19]

Morris, Jr.

[11] Patent Number: 4,719,766

[45] Date of Patent: Jan. 19, 1988

[54] DEFROST GAS CONDITIONER FOR AIR COOLED REVERSE CYCLE DEFROST REFRIGERATION SYSTEM

[76] Inventor: William F. Morris, Jr., P.O. Box 1046, Raleigh, N.C. 27602-1046

[21] Appl. No.: 771,359

[22] Filed: Aug. 30, 1985

[51] Int. Cl.[4] ..... F25B 47/00

[52] U.S. Cl. ..... 62/278; 62/352

[58] Field of Search ..... 62/277, 278, 509, 196.4, 62/81, 83, 473, 512, 352

[56] References Cited

U.S. PATENT DOCUMENTS

| | | | |
|---|---|---|---|
| 3,034,310 | 5/1962 | Lowe | 62/352 X |
| 3,138,007 | 6/1964 | Friedman et al. | 62/278 |
| 4,180,986 | 1/1980 | Shaw | 62/196.4 X |

FOREIGN PATENT DOCUMENTS

| | | | |
|---|---|---|---|
| 1107153 | 12/1955 | France | 62/278 |

*Primary Examiner*—Harry Tanner

*Attorney, Agent, or Firm*—Mason, Fenwick & Lawrence

[57] ABSTRACT

A reverse cycle defrost refrigeration system including a compressor, an air cooled condenser, an evaporator having surfaces for forming ice thereon during a freezing cycle and arranged to discharge the ice therefrom during a defrost cycle, and a defrost cycle arrangement to supply hot gaseous refrigerant to the evaporator during the defrost cycle including a defrost conduit connected to the condenser for releasing flash gas to the evaporator at the time the defrost cycle begins. A liquid separator surge tank is provided to condition warm defrost gaseous refrigerant which passes back through the defrost conduit to the evaporator at the beginning of the defrost cycle from carrying slugs of liquid refrigerant that may be in the condenser into the evaporator, having an inlet conduit connected to the top of the tank and an outlet conduit exiting from the tank neat the bottom thereof to separate and accumulate any slugs of liquid refrigerant or oil that may be entrained with the flash gas.

1 Claim, 1 Drawing Figure

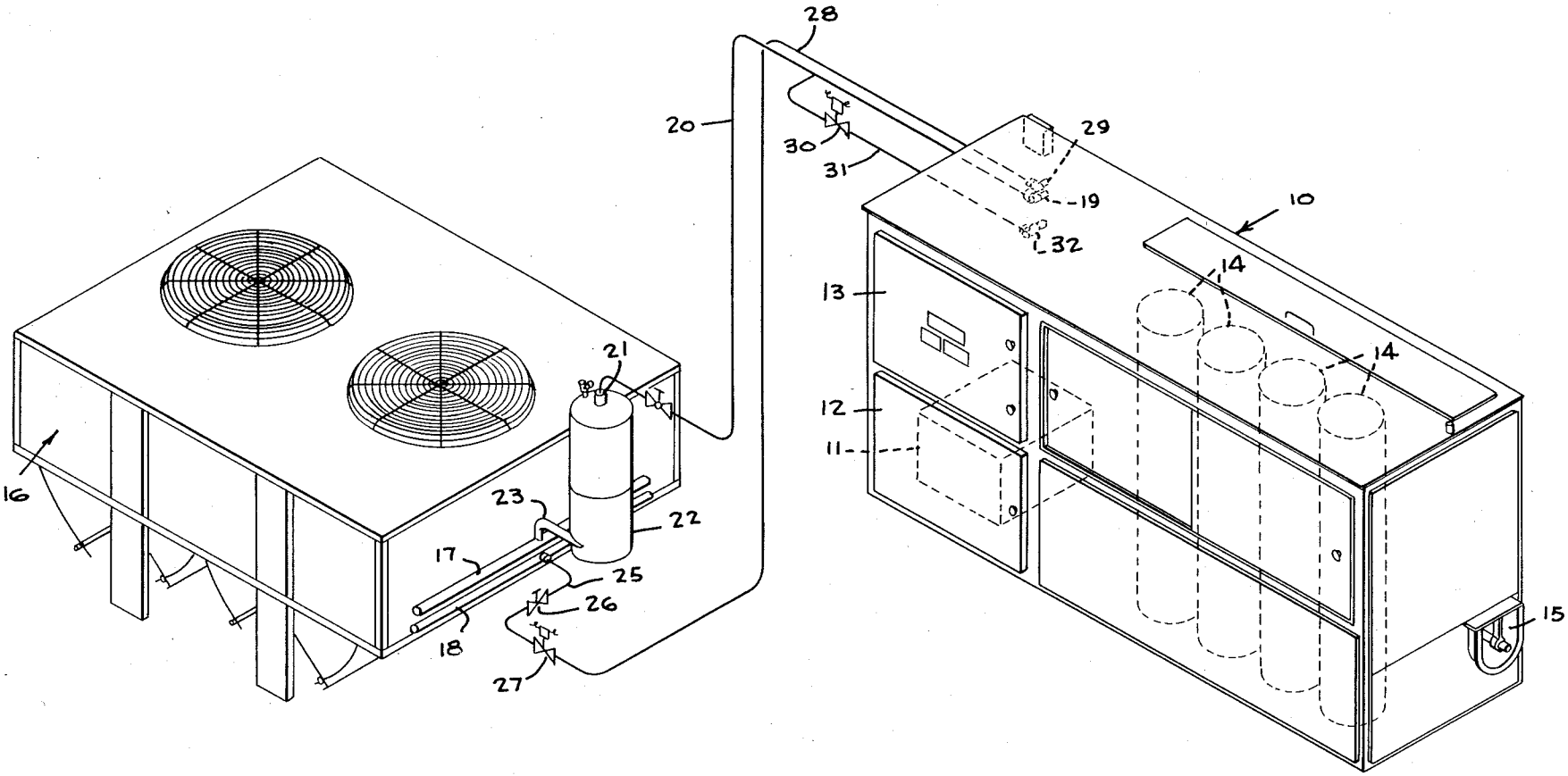
10
11
12
13
14
14
15
16
17
18
19
20
21
22
23
25
26
27
28
29
30
31
32

DEFROST GAS CONDITIONER FOR AIR COOLED REVERSE CYCLE DEFROST REFRIGERATION SYSTEM

BACKGROUND AND SUMMARY OF THE INVENTION

The present invention relates in general to refrigeration systems, and more particularly to defrost gas conditioning means for air cooled reverse cycle defrost refrigeration systems.

On an air cooled reverse cycle defrost refrigeration system such as the "Ice-Master" Ice Maker produced by Morris and Associates of Raleigh, N.C., operating on a similar principal to the C. E. Lowe U.S. Pat. Nos. 3,280,585, or 3,026,686 or 3,034,310, when the machine goes on defrost the opening of the hot gas solenoid valve allows instantaneous release of the discharge gas pressure from the high side into the evaporator surface to accomplish the defrost as quickly and effectively as possible. It is estimated that approximately ½ of this hot gas required for defrost of the subject ice maker comes from the flash gas in the condenser at the time the defrost solenoid valve is opened. Tne balance of the heat required for the defrost comes more slowly and on a continuing basis from the discharge gas of the compressor as it continues to operate during the defrost cycle.

The suddeness of the pressure release when the solenoid valve opens causes an instantaneous "flashing" or boiling of any liquid refrigerant that may be in the condenser at the time together with a rapid versal of flow in both the condenser and discharge line to the condenser.

Depending on the amount of liquid in the air cooled condenser and tne pressures in the condenser before and after the pressure release as well as both the temperature and mass of the condenser itself, there is a very real possibility as a result that slugs of liquid refrigerant from the condenser will be carried back througn the discharge line and to the defrost solenoid and into the evaportors with tne possibility of damage to the lines from "hydraulic-hammer" as well as damage to the compressor from liquid slugging.

One possibility of solving this problem is to install a check valve in the compressor discharge line at the inlet to the condenser, but this would eliminate the benefits of the flash gas contribution to defrost which can amount to as much as 10% of the ice capacity of the system and may increase electric KWH per ton of ice as much as 10%.

Therefore, what is needed is a means of conditioning this warm defrost gas rushing back from the condenser so as to insure that no slugs of liquid refrigerant or oil that may be carried along with it can pass back into the discharge line from the condenser to cause the above problems.

This may be accomplished by a surge accumulator tank installed at the point where the compressor discharge line enters the air cooled condenser.

One other very significant characteristic of this type problem is that it occurs intermittently or spasmodically and is extremely hard to identify or predict because of the wide range of atmospheric conditions encountered in an air cooled system, especially one utilizing reverse cycle defrost. The tragedy is that it only takes one slug of liquid to either destroy a compressor or rupture a line and it occurs so fast that you may not be able to figure out what happened.

Installation of a surge accumulator type defrost gas conditioner in accordance with the present invention proves to be the best remedy for this problem without incurring a severe penalty of capacity loss and increase of operating cost.

BRIEF DESCRIPTION OF THE FIGURES

The FIGURE is a somewnat diagrammatic perspective view of a reverse cycle defrost refrigeration system having an air cooled condenser and the surge accumulator tank of the present invention.

DETAILED DESCRIPTION OF A PREFERRED EMBODIMENT

Referring to the drawing, the FIGURE is a diagrammatic perspective view of a reverse cycle defrost icemaker refrigeration system embodying the present invention, which includes a first unit 10, which is the main ice maker unit, having a generally rectangular housing enclosing a compressor, diagrammatically illustrated at 11 behind a compressor access door 12, an electrical panel (not shown) covered by an eiectrical panel access door 13, and a plurality of ice maker evaporators, for example elongated tube evaporators, indicated diagrammatically at 14, which may be of the types disclosed in the previously identified patents. The evaporator tubes during the freezing cycle form ice on the exterior surface thereof and, during the hot gas defrost cycle, for example as described in the above identitied earlier patents, the ice is gravitational discharged into a trough and moved by a conveyor such as a screw conveyor, as illustrated at 15 in the FIGURE, to a discharge station. The refrigeration system also includes a remote air cooled condenser unit, indicated generally by the reference character 16, having the usual refrigerant conducting heat exchange coils and air propelling fans, as is well-known in the refrigeration art, for condensing the hot gas refrigerant provided by the compressor 11 to liquid state and supplying the liquid refrigerant to the inlet to the evaporators 14. In the physical form of the remote air cooled condenser 16 as iliustrated in the FIGURE, a gaseous refrigerant header 17 is located along one side thereof, below which is a liquid refrigerant header 18 connected to the coils in the condenser 16.

As will be well understood to those skilled in the refrigeration art, hot gaseous refrigerant from the compressor 11 is supplied from a compressor discharge line connection 19 on the unit 10 through a compressor discharge line 20 to the inlet connection 21 at the top of the liquid separator surge accumulator tank 22 located at the side of the condenser 16 above the level of the hot gas supply header 17. A hot gas outlet from the surge tank 22 is connected through conduit 23 which exits the tank 22 tangentially near the lower end of the surge tank 22 to the hot gas supply header 17 for the condenser 16. The surge accumulator tank may be, for example, similar to the accumulator tank 19 of my U.S. Pat. No. 3,922,875, but without coil 18.

The liquid refrigerant header 18 of the condenser 16 is connected through a conduit 25 including a hand valve 26 and a liquid line defrost solenoid 27 to a liquid refrigerant line or conduit 28 leading to the liquid line connection 29 at the compressor-evaporator unit 10 which supplies liquid refrigerant from the condenser 16 to a distributor, in accordance with wellknown practice, connected to the ice making evaporators or tubes !4. To place the system in defrost cycle mode, a compressor discharge line defrost solenoid valve 30 is provided in a conduit 31 connected by a T connection as shown to the hot gas refrigerant discharge line or compressor discharge line 20, and connects to a hot gas connection 32 on the unit 10 connected to the evaporators 14 for connecting the compressor discharge line 20 to the hot gas connection with the evaporators during the defrost cycle.

As will be understood, when the refrigeration system is in the ice making or freezing mode, the compressor discharge defrost solenoid 30 is closed and the liquid line defrost solenoid 27 is open, admitting liquid refrigerant from the liquid refrigerant header 18 of the condenser 16 through the line 28 to the liquid line connection 29 and thus to the evaporators 14 to effect freezing of water discharged on the surfaces of the evaporators to form ice. When the system is switched to the defrost cycle mode, the compressor discharge defrost solenoid 30 is opened and the liquid line defrost solenoid 27 is closed. The sudden pressure release when the solenoid valve 30 opens and the valve 27 closes causes an instantaneous "flashing" or boiling of any liquid refrigerant that may be in the condenser 16 at that time, together with rapid reversal of flow in both the condenser and discharge line to the condenser. Since the liquid separator surge accumulator tank 22 is interposed in the conduit system between the hot gas header 17 at the inlet to the condenser 16 and the conduit 20 and its connection through conduit 31 and now open solenoid valve 30 to the evaporators, this prevents the slugs of liquid refrigerant that may be in the condenser from being carried back through the discharge line 20 and line 31 to tne evaporators and thus avoid possibility of damage to the lines from "hydraulic-hammer" as well as avoiding damage to the compressor from liquid slugging. There is no problem with getting rid of any liquid remaining in the surge tank 22 once the system returns to the normal refrigeration cycle, since the super-heated compresser discharge gas very quickly heats up the surge tank 22 and boils off any liquid refrigerant which may have remained in the surge tank, carrying this into the condenser 16 along with the flow of discharge gas from the compressor.

I claim:

1. In a reverse cycle defrost refrigeration system having a compressor, an air cooled condenser and avaporator means having surfaces for forming ice thereon during a freezing cycle and arranged to discharge the ice therefrom during a defrost cycle, conduit means for conducting gaseous refrigerant from the compressor to the condenser to be condensed to liquid refrigerant in the condenser and conduit means for conducting the liquid refrigerant to the evaporator means during the freezing cycle, defrost cycle means including a defrost conduit means having defroat solenoid valve connected to the condenser hot gas supply form the compressor and a discharge conduit connected thereto and to the evaporator means to supply hot gaseous refrigerant to the evaporator means during the defrost cycle, the defrost conduit means being connected to the condenser for releasing flash gas from the condenser to the evaporator at the time the defrost solenoid valve opens; the improvemnet comprising means for conditioning warm defrost gaseous refrigerant which passes back through the discharge conduit to the defrost solenoid valve and the evaporator means at the beginning of the defrost cycle from carrying slugs of liquid refrigerant that may be in the condenser into the discharge conduit and evaporator means and compressor including a liquid separator surge tank and an inlet conduit connected to the top of the surge tank above the level of the discharge conduit connection to the condenser connected to said discharge conduit and a surge tank outlet conduit exiting tangentially from said surge tank near the bottom thereof and connected to said discharge conduit connection to said condenser to pass hot gas refrigerant from the compressor to the evaporator means and convey flash gas from the condenser through said discharge conduit to the evaporator means and to separate and accumulate in said surge tank any slugs of liquid refrigerant or oil that may be entrained with the flash gas.

* * * * *